US009175584B2

(12) United States Patent
Lee et al.

(10) Patent No.: US 9,175,584 B2
(45) Date of Patent: Nov. 3, 2015

(54) SINTERED ALLOY FOR VALVE SEAT AND MANUFACTURING METHOD OF EXHAUST VALVE SEAT USING THE SAME

(71) Applicants: Hyundai Motor Company, Seoul (KR); Kia Motors Corporation, Seoul (KR); Korea Powder Metallurgy Co., Ltd., Asan-si (KR)

(72) Inventors: Philgi Lee, Suwon-si (KR); Gyuhwan Kim, Suwon-si (KR); Jae Suk Park, Suwon-si (KR); Ki Bum Kim, Seoul (KR); Chang-Jin Shin, Gimpo-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 293 days.

(21) Appl. No.: 13/718,373

(22) Filed: Dec. 18, 2012

(65) Prior Publication Data

US 2013/0259733 A1 Oct. 3, 2013

(30) Foreign Application Priority Data

Apr. 2, 2012 (KR) ..... 10-2012-0033989

(51) Int. Cl.

| | |
|---|---|
| ***B22F 3/16*** | (2006.01) |
| ***F01L 3/02*** | (2006.01) |
| ***B22F 5/00*** | (2006.01) |
| ***C22C 33/02*** | (2006.01) |
| *B22F 3/24* | (2006.01) |

(52) U.S. Cl.

CPC ... *F01L 3/02* (2013.01); *B22F 3/16* (2013.01); *B22F 5/00* (2013.01); *B22F 5/008* (2013.01); *C22C 33/0221* (2013.01); *C22C 33/0285* (2013.01); *B22F 2003/248* (2013.01)

(58) Field of Classification Search

None

See application file for complete search history.

(56) References Cited

U.S. PATENT DOCUMENTS

| | | | | |
|---|---|---|---|---|
| 4,080,205 | A * | 3/1978 | Niimi et al. | 75/241 |
| 5,221,321 | A * | 6/1993 | Lim | 75/246 |
| 5,529,602 | A * | 6/1996 | Ishii et al. | 75/231 |
| 6,082,317 | A * | 7/2000 | Takahashi et al. | 123/188.8 |
| 2004/0000283 | A1 * | 1/2004 | Narasimhan et al. | 123/188.8 |
| 2004/0187830 | A1 * | 9/2004 | Sato et al. | 123/188.8 |
| 2005/0193861 | A1 * | 9/2005 | Sato et al. | 75/246 |
| 2011/0284792 | A1 * | 11/2011 | Kim et al. | 251/368 |

FOREIGN PATENT DOCUMENTS

| | | | |
|---|---|---|---|
| JP | 11-71651 | A | 3/1999 |
| JP | 2004-027357 | B2 | 1/2004 |
| JP | 2004-149819 | A | 5/2004 |
| JP | 2005-248234 | A | 9/2005 |
| JP | 2006-291300 | B2 | 10/2006 |
| JP | 2006-316745 | A | 11/2006 |
| KR | 1996-0013894 | B1 | 10/1996 |
| KR | 1020040001721 | A | 1/2004 |

* cited by examiner

*Primary Examiner* — George Wyszomierski
*Assistant Examiner* — Ngoclan T Mai
(74) *Attorney, Agent, or Firm* — Morgan, Lewis & Bockius LLP

(57) ABSTRACT

A sintered alloy for a valve seat may be manufactured using a method including: mixing MnS with an alloy powder for a valve seat including C at 0.8-1.2 wt %, Ni at 2.0-4.5 wt %, Cr at 3.0-5.0 wt %, Mo at 16.0-20.0 wt %, Co at 9.0-13.0 wt %, V at 0.05-0.15 wt %, S at 0.2-0.8 wt %, Fe, and additional inevitable impurities; making a first shape by forming the mixed materials; pre-sintering the first formed shape; making a secondary shape by re-pressing the first pre-sintered shape; main-sintering the secondary shape; and tempering the main-sintered secondary shape.

6 Claims, 4 Drawing Sheets

SINTERED ALLOY FOR VALVE SEAT AND MANUFACTURING METHOD OF EXHAUST VALVE SEAT USING THE SAME

CROSS-REFERENCE TO RELATED APPLICATION

The present application claims priority of Korean Patent Application Number 10-2012-0033989 filed Apr. 2, 2012, the entire contents of which application is incorporated herein for all purposes by this reference.

BACKGROUND OF INVENTION

1. Field of Invention

The present invention relates to valve seats. More particularly, the present invention relates to a sintered alloy for valve seats in which MnS is added for improving machinability and tempering, and a manufacturing method valve seat using the same.

2. Description of Related Art

A valve seat of engine components for vehicles is a component that contacts a valve surface and maintains an airtight seal in a combustion chamber. The valve seat is repeatedly impacted so it needs to be manufactured so it cannot be damaged by the repeated impacts.

A traditional wear-resistant sintered alloy for a valve seat has iron (Fe) as its main component, and contains carbon (C) at 0.4-1.0 wt %, silicon (Si) at 0.1-1.0 wt %, chromium (Cr) at 0.5-2.0 wt %, molybdenum (Mo) at 6.0-10.0 wt %, cobalt (Co) at 6.0-15.0 wt %, and lead (Pb) at 6.0-18.0 wt %. The manufacturing process thereof is as follows.

Firstly, a metal powder except lead of the components is mixed, and it is formed by surface pressure of 4-8 ton/cm$^2$.

It is pre-sintered in the range of 750-800° C. for 40 minutes in a reduction atmosphere, and forged by surface pressure of 7-10 ton/cm$^2$.

Main sintering is then performed in a hydrogen atmosphere in the range of 1110-1140° C. for 30-50 minutes, a resin is impregnated to improve workability, and a barrel process is performed to manufacture a wear-resistant sintered alloy for valve seat.

However, the sintered alloy for the valve seat manufactured by the components and content induces excessive abrasion of tools and tearing, and the workability is not good. Therefore, improvement is needed.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a sintered alloy for a valve seat and a manufacturing method of an exhaust valve seat using the same having advantages of improving solid lubrication, roughness of the valve seat, and surface conditions by forming a Co—Mo—Cr—Si hard phase by adding MnS and performing tempering.

The present invention according to various aspects presents a sintered alloy for a valve seat, and MnS is added to the sintered alloy that includes C at 0.8-1.2 wt %, Ni at 2.0-4.5 wt %, Cr at 3.0-5.0 wt %, Mo at 16.0-20.0 wt %, Co at 9.0-13.0 wt %, V at 0.05-0.15 wt %, S at 0.2-0.8 wt %, Fe, and additional inevitable impurities.

An amount of MnS of 0.2-2.5 parts by weight with respect to 100 parts by weight of the sintered alloy is added, the size of MnS particles is smaller than 12 μm, and the MnS includes Mn at 60-65 wt % and S at 35-40 wt % according to various aspects of the present invention.

Various aspects of the present invention provide for a method that includes steps of: mixing MnS with an alloy powder for a valve seat including C at 0.8-1.2 wt %, Ni at 2.0-4.5 wt %, Cr at 3.0-5.0 wt %, Mo at 16.0-20.0 wt %, Co at 9.0-13.0 wt %, V at 0.05-0.15 wt %, S at 0.2-0.8 wt %, Fe, and additional inevitable impurities; making a first shape by forming the mixed materials; pre-sintering the first formed shape; making a secondary shape by re-pressing the first pre-sintered shape; main-sintering the secondary shape; and tempering the main-sintered secondary shape.

The amount of MnS is from 0.2 to 2.5 parts by weight with respect to 100 parts by weight of the alloy powder, the tempering temperature is from 180° C. to 220° C., and the tempering time is from 100 minutes to 150 minutes according to various aspects of the present invention.

Various aspects of the present invention provide for a method including the steps of permeating oil into the tempered secondary shape, and processing and barreling the oil-permeated secondary shape.

A valve seat may be manufactured by the above sintered alloy.

Solid lubrication, roughness of the valve seat, and surface conditions may be improved by forming a Co—Mo—Cr—Si hard phase by adding MnS and performing tempering.

In addition, wear-resistance of the valve seat may be improved without increasing bite-abrasion loss, and a tearing phenomenon is prevented.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
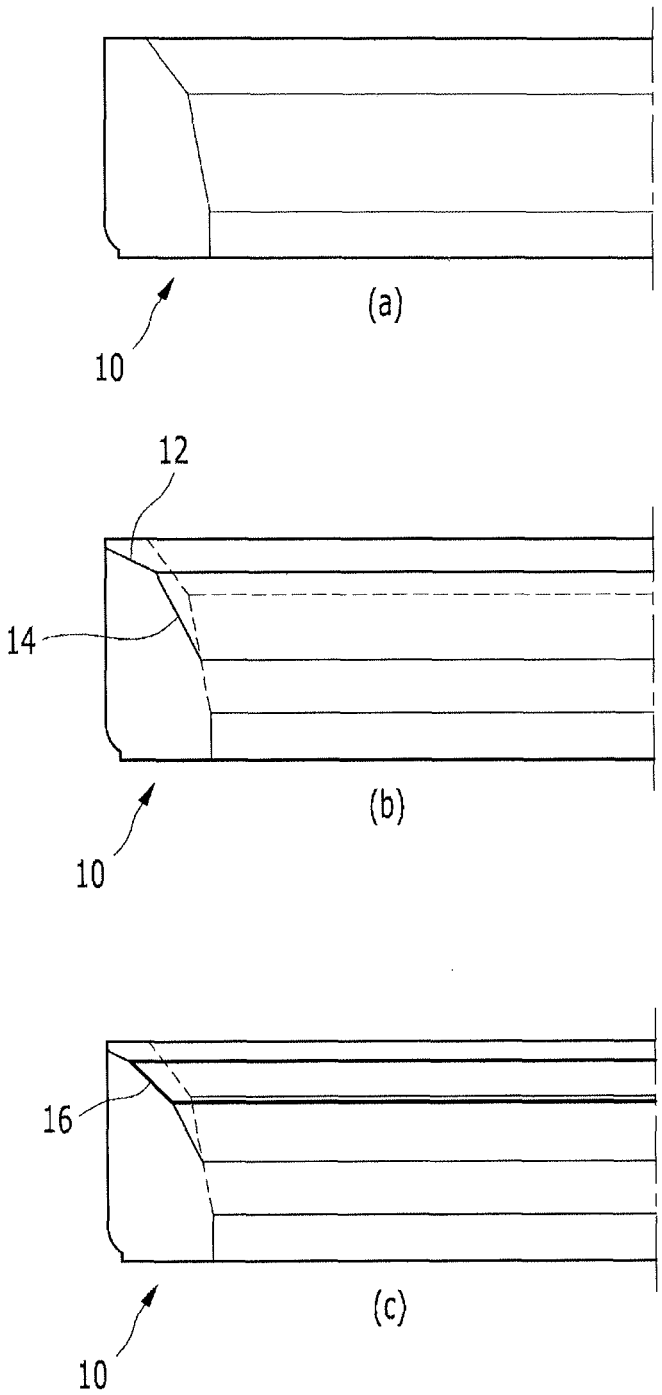
FIG. 1 is a schematic view of various aspects of the present invention according to a processing sequence of a valve seat.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

According to various embodiments of the present invention, a sintered alloy for valve seat is manufactured by adding MnS to a sintered alloy that includes, in the unit of wt %, Cat 0.8-1.2, Ni at 2.0-4.5, Cr at 3.0-5.0, Mo at 16.0-20.0, Co at 9.0-13.0, V at 0.05-0.15, S at 0.2-0.8, Fe, and additional inevitable impurities.

The MnS is contained at 0.2-2.5 parts by weight with respect to 100 parts by weight of the sintered alloy, and the valve seat is manufactured with the sintered alloy contained the MnS.

The limitation reasons for numerical values according to various embodiments of the present invention are explained hereinafter.

First, carbon is added to iron (Fe) so that wear-resistance according to strength and hardness increments is improved and the strength of a matrix is enhanced. If the amount of carbon is less than 0.8 wt %, pearlite and ferrite are excessively formed so that the matrix is softened and the strength and wear-resistance are deteriorated, and if the amount of carbon is larger than 1.2 wt %, the carbon retained after forming pearlite forms network-structure cementite so that the matrix is weak.

Therefore, the content of carbon in various embodiments of the present invention is limited to 0.8-1.2 wt %.

When the Ni is added and diffused in the matrix metal, it improves heat-resistance and high temperature characteristics. If the amount of the Ni is less than 2.0 wt %, the above effects are slightly shown, whereas if the amount of the Ni is larger than 4.5 wt %, the matrix structure is changed into martensite and Ni-rich austenite, so that the structure is unstable and the hardness increases excessively thus deteriorating mechanical working.

Therefore the content of Ni in various embodiments of the present invention is limited to 2.0-4.5 wt %.

The Cr forms a Co—Mo—Cr—Si phase, which is a hard phase, along with the Co, Mo, and Si components, so that wear-resistance is improved, and Cr plays a role as a lubricant by precipitating CrS in the matrix. If the content of Cr is less than 3.0 wt %, the Co—Mo—Cr—Si phase, which is the hard phase, and the CrS, which is a solid lubricant, are marginally formed so that the wear-resistance is deteriorated.

When the content of Cr is larger than 5.0 wt %, the Co—Mo—Cr—Si phase and CrS are excessively formed so that the metal matrix is weak.

Therefore, the content of Cr in various embodiments of the present invention is limited to 3.0-5.0 wt %.

In the Co—Mo—Cr—Si phase, the amounts of the components are respectively Mo at 50 wt %, Cr at 9 wt %, Si at 3 wt %, and Co as a balance.

However, the above amounts of components are exemplary for optimized effect, so the contents are not limited to the amounts.

The Mo forms a Co—Mo—Cr—Si phase, which is a hard phase, in common with Co, so that the wear-resistance is enhanced and improved by an Fe—Mo phase by diffusing in the Fe matrix. If the amount of Mo is less than 16.0 wt %, the Co—Mo—Cr—Si phase and the Fe—Mo phase are slightly formed, so that the wear-resistance is deteriorated, whereas if the amount of Mo is larger than 20.0 wt %, the Co—Mo—Cr—Si phase and the Fe—Mo phase are excessively formed, so that the matrix metal is weak.

Therefore the content of the Mo in various embodiments of the present invention is limited to 16.0-20.0 wt %.

The Cr forms a Co—Mo—Cr—Si phase, which is a hard phase, in common with Mo, so that the wear-resistance is enhanced. If the amount of the Cr is less than 9.0 wt %, the Co—Mo—Cr—Si phase is slightly formed so that the wear-resistance is deteriorated, whereas if the amount of the Cr is larger than 13.0 wt %, the Co—Mo—Cr—Si phase is excessively formed, so the matrix metal is weak.

Therefore, the content of the Cr in various embodiments of the present invention is limited to 9.0-13.0 wt %.

The V (vanadium) in various embodiments of the present invention is combined into the carbon and forms particulated carbide so that the wear-resistance and high temperature strength are improved. If the amount of the V is less than 0.05 wt %, the effects are slight, whereas if the amount of the V is larger than 0.15 wt %, $V_2O_5$ oxide is easily formed. Because the steam pressure of the oxide is high, it is easily evaporated at a high temperature.

Therefore, the content of the V in various embodiments of the present invention is limited to 0.05-0.15 wt %.

In addition, sulfur (S) is added as a solid lubricant and combined with Cr, and forms CrS in the interior of particles.

If the amount of S is less than 0.2 wt %, the precipitated amount of solid lubricant is small so the effects are slight, whereas if the amount of S is larger than 0.8 wt %, the amount of the CrS is excessive, so the strength of the matrix is deteriorated.

Therefore, the content of the S in various embodiments of the present invention is limited to 0.2-0.8 wt %.

Also, the sintered alloy for a valve seat, in various embodiments of the present invention, contains iron (Fe) as a main component and MnS is added to the alloy powder for a valve seat to improve tool-wearing and machinability.

The MnS, in various embodiments of the present invention, exists in holes without reacting with adjacent elements, so the machinability and solid lubrication can be improved.

In various embodiments of the present invention, in the MnS, with a particle size of less than or equal to 12 μm, is uniformly distributed, the content of the MnS is 60-65 wt %, and the content of the S is 35-40 wt %. The MnS is not decomposed into a compound at a high temperature and is stable, so the MnS is retained in the holes of the sintered body as MnS after sintering. As a result, a sintered body of which the machinability is good can be obtained during machining by reducing bite friction coefficients.

Further, because the MnS plays a role as a solid lubricant, the MnS can reduce the impact between metals and frictional force.

If the amount of the MnS is less than 0.5 parts by weight with respect to 100 parts by weight of the sintered alloy (alloy powder), the effect is slight, whereas if the amount of the MnS is larger than 2.5 parts by weight with respect to 100 parts by weight of the sintered alloy, the strength of the matrix is decreased so that a fracture can easily occur during pressing of the valve seat into a cylinder head.

Therefore, the content of the MnS in various embodiments of the present invention is limited to 0.5-2.5 parts by weight with respect to 100 parts by weight of the sintered powder (alloy powder).

Hereinafter the manufacturing method of the valve seat in various embodiments of the present invention will be described.

Figure 4:
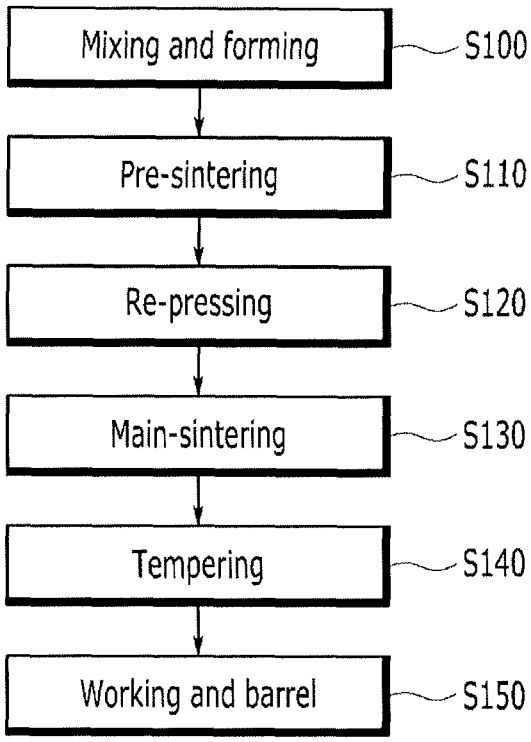
FIG. 4 is a flowchart for a manufacturing process of an exemplary valve seat according to the present invention.

FIG. 4 is a flowchart of a manufacturing process of a valve seat according to various embodiments of the present invention. Referring to FIG. 4, 1.0~2.0 parts by weight of MnS with respect to 100 parts by weight of the alloy powder is added to the alloy powder composed of C at 0.8-1.2 wt %, Ni at 2.0-4.5 wt %, Cr at 3.0-5.0 wt %, Mo at 16.0-20.0 wt %, Co at 9.0-13.0 wt %, V at 0.05-0.15 wt %, S at 0.2-0.8 wt %, Fe, and additional inevitable impurities.

The mixed alloy powder and the MnS are made into a first shape considering the demanded density and entire length by first forming (S100).

Then, pre-sintering is performed (S110), and the process is fulfilled in the range of 750-800° C. during 2.5 hours.

The pre-sintering process is a process in which ductility is improved by diffusing a little carbon into the first formed shape for re-pressing (forging) (S120), which is a process for enhancing the density.

After the pre-sintering process, the first formed shape is re-pressed (S120), so the secondary shape is materialized and the density is increased by exerting a force of 10 ton/cm$^2$.

The materials in the re-pressing process are combined physically, and the secondary shape can be combined chemically by main-sintering (S130).

The materials are kept in the range of 1110-1140° C. for 5 hours during main-sintering, and particularly for 50 minutes in a high temperature region.

After the main-sintering, residual stress is occurred in the secondary shape, a tempering process (S140) in which the temperature is constant in the atmosphere is performed to remove the residual stress.

The tempering temperature in various embodiments of the present invention is in the range of 180-220° C., and tempering time is in the range of 100-150 minutes.

The stress between structures is moderated by the tempering.

And then, an oil-containing process which interfuses oil into the secondary shape in a vacuum state to improve the machinability of the products and prevent occurring of rust is performed.

After the oil-containing process is finished, the oil-interfused secondary shape is mechanically processed in dimension and shape, which is not materialized by the powder metal (PM) method, a barrel process (S150) that burrs and impurities are removed after the process is carried out to maintain the optimum surface state.

When the barrel process is finished, defects on the product surface are detected early and the final check can find them so the product will not to be delivered to customers.

Hereinafter, various embodiments of the present invention will be described in more detail.

However the scope of the present invention is not limited thereto.

EXAMPLE

The MnS at 1.5 parts by weight with respect to 100 parts of alloy powder, in various embodiments of the present invention, is uniformly blended in the alloy powder composed of Fe at 59.5 wt %, Ni at 3.15 wt %, Mo at 18.24 wt %, Cr at 4.27 wt %, C at 1.04 wt %, Co at 11.6 wt %, Mn at 0.95 wt %, Sat 0.88 wt %, V at 0.1 wt %, and additional inevitable impurities, and the blended alloy powder is pressed to manufacture a sintered alloy for a valve seat, and the pressed alloy powder is formed, sintered, and tempered at 200° C. for 120 minutes.

The abrasion loss of the manufactured valve seat by the above method is measured.

A valve seat 10 can be divided into seat portions 12, 14, and 16 and non-seat portions, and the seat portions 12, 14 and 16 are the focus on an experiment in various embodiments of the present invention.

The non-seat portions in various embodiments of the present invention mean the lower part of seat portions 12, 14 and 16 in FIG. 1, where friction with the valve is insignificant.

FIG. 1 shows processing sequences for the valve seat 10 according to various embodiments of the present invention, wherein the seat portion 16 is processed after seat portions 12 and 14 are processed.

The seat portion 16 is a portion where the valve seat 10 contacts the valve in FIG. 1(*c*), and the seat portions 12 and 14 are auxiliary surfaces for forming the seat portion 16.

Seat portions 12, 14 and 16 in FIG. 1 make surfaces A, B and C respectively.

Experimental Method

To test the performance of the valve seat according to various embodiments of the present invention, the test is fulfilled at RPM of 1100, FEED of 124.4, and FEED RATE of 0.11 during the processing, 1000 products each material are worked, and the seat portion 16 is processed after the seat portion 12 and 14 are processed. The test results are shown in Table 1 and Table 2.

In the comparative example, the MnS and resin are added, but tempering is not performed.

TABLE 1

| Machinability | | | | |
|---|---|---|---|---|
| | Roughness | B surface state | | |
| Classification | of B surface (Rt) | Maximum hole size (μm) | # of pores (>100 μm) | Bite abrasion loss (mm) |
| Comparative Example | 7.5 | 471.2 | 8.6 | 0.068 |
| Exemplary Embodiment | 3.6 | 170.8 | 1.4 | 0.052 |

TABLE 2

| Material Properties | | | | |
|---|---|---|---|---|
| | Hardness | Density | Microhardness (mHv 100 gf) | |
| Classification | (HRA) | (g/cm$^3$) | Hard Phase | Matrix |
| Comparative Example | 67.8 | 7.27 | 1339.8 | 446.5 |
| Exemplary Embodiment | 63.4 | 7.24 | 1317.3 | 420.5 |

As shown in the Table 1, the surface hardness of the valve seat according to various embodiments is improved compared to the comparative example.

Figure 2:
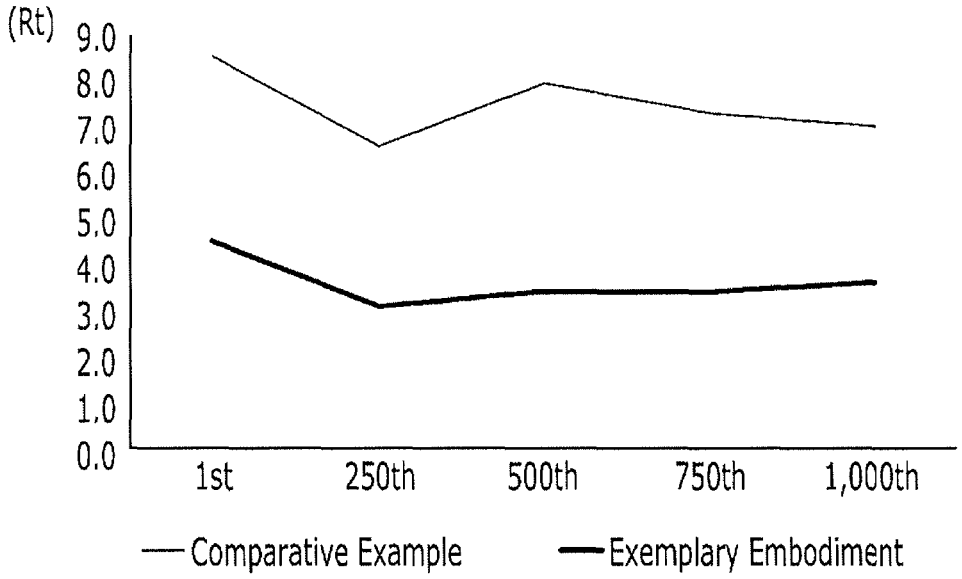
FIG. 2 is a graph of an exemplary valve seat representing roughness according to the present invention.

FIG. 2 shows the surface roughness of the valve seat according to various embodiments of the present invention, wherein the surface roughness (Rt) is an average value of 5 tests of 1000 products for the each material.

In addition, the maximum pore size in various embodiments of the present invention is reduced to under half of that of the comparative example, and the number of pores that are larger than 100 μm is markedly reduced.

Figure 3:
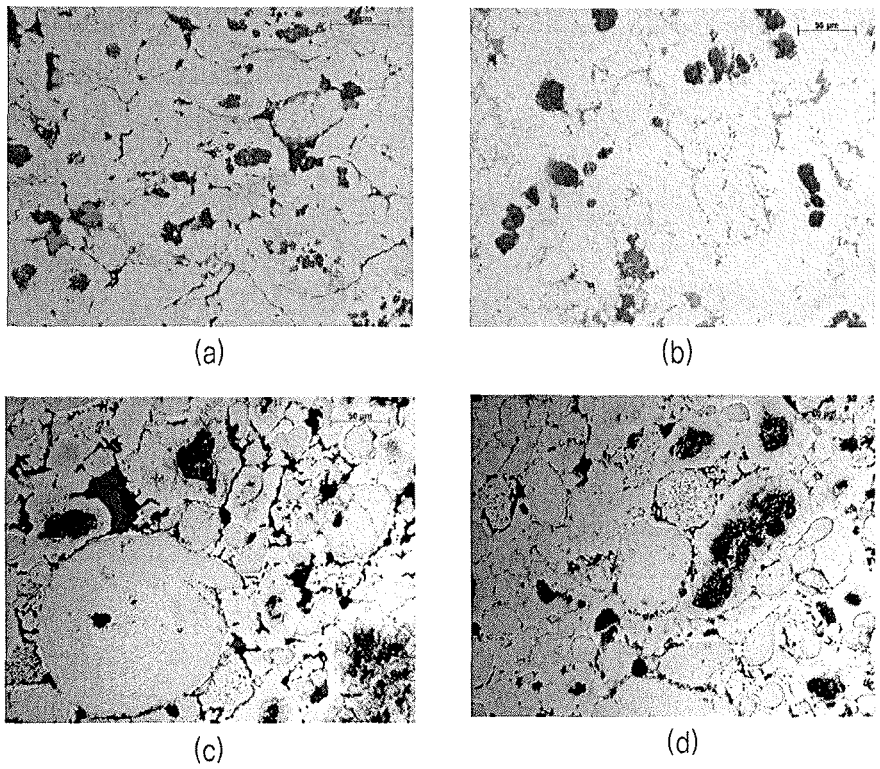
FIG. 3 shows photographs of exemplary metallic structures before and after corrosion according to a comparative example and an exemplary embodiment of the present invention.

FIG. 3 shows photographs of metallic structures before and after corrosion, and the photographs are magnified 200 times. Referring to FIG. 3, (a) and (b) are respectively photographs of a metallic structure before and after corrosion according to the comparative example and an exemplary embodiment, and (c) and (d) are respectively photographs of metallic structures before and after corrosion according to the comparative example and various embodiments.

As shown in FIG. 3, there are large changes in the comparative example after corrosion, whereas there are few changes in various embodiments of the present invention, so we can know that the valve seat according to the present invention has better corrosion-resistance.

In addition, fewer than 300 holes can be worked in the comparative example, whereas more than 1400 holes in the valve seat according to various embodiments can be worked, and in various embodiments resin is not used, so a tearing phenomenon of a worked surface does not occur.

Therefore, the valve seat according to various embodiments of the present invention is particularly suitable for the contact portion with the valve.

For convenience in explanation and accurate definition in the appended claims, the terms lower and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A manufacturing method of a valve seat, the method comprising:

mixing MnS with an alloy powder for the valve seat comprising C at 0.8-1.2 wt %, Ni at 2.0-4.5 wt %, Cr at 3.0-5.0 wt %, Mo at 16.0-20.0 wt %, Co at 9.0-13.0 wt %, V at 0.05-0.15 wt %, S at 0.2-0.8 wt %, Fe, and additional inevitable impurities;

making a first shape by forming the mixed materials;

pre-sintering a first formed shape;

making a secondary shape by pressing a first pre-sintered shape;

main-sintering the secondary shape; and tempering the main-sintered secondary shape.

2. The method of manufacturing the valve seat of claim 1, wherein the amount of MnS is from 0.2 to 2.5 parts by weight with respect to 100 parts by weight of the alloy powder.

3. The manufacturing method of the valve seat of claim 1, wherein a tempering temperature is from 180° C. to 220° C.

4. The manufacturing method of the valve seat of claim 1, wherein a tempering time is from 100 minutes to 150 minutes.

5. The manufacturing method of the valve seat of claim 1, wherein the method comprises a further step of permeating oil into the tempered secondary shape.

6. The manufacturing method of the valve seat of claim 5, wherein the method comprises a further step of processing and barreling the oil-permeated secondary shape.

* * * * *